US008629746B2

(12) United States Patent
Lu

(10) Patent No.: US 8,629,746 B2
(45) Date of Patent: Jan. 14, 2014

(54) HIGH FREQUENCY TRANSFORMERS

(75) Inventor: Jun Wei Lu, Calamvale (AU)

(73) Assignee: HBCC Pty Ltd, Sunnybank Hills, Queensland (AU)

( * ) Notice: Subject to any disclaimer, the term of this patent is extended or adjusted under 35 U.S.C. 154(b) by 0 days.

(21) Appl. No.: 13/144,297

(22) PCT Filed: Jan. 29, 2010

(86) PCT No.: PCT/AU2010/000092

§ 371 (c)(1),
(2), (4) Date: Aug. 16, 2011

(87) PCT Pub. No.: WO2010/085585

PCT Pub. Date: Aug. 5, 2010

(65) Prior Publication Data

US 2011/0291792 A1 Dec. 1, 2011

(30) Foreign Application Priority Data

Jan. 30, 2009 (AU) ..... 2009900336

(51) Int. Cl.

| | |
|---|---|
| ***H01F 27/32*** | (2006.01) |
| ***H01F 27/28*** | (2006.01) |
| ***H01F 27/24*** | (2006.01) |
| ***H01F 17/04*** | (2006.01) |

(52) U.S. Cl.

USPC ..... 336/84 C; 336/170; 336/212; 336/221; 336/232

(58) Field of Classification Search

USPC ..... 336/84 C, 84 M, 170, 182, 212, 336/220–222, 232

See application file for complete search history.

(56) References Cited

U.S. PATENT DOCUMENTS

| | | | | |
|---|---|---|---|---|
| 4,089,049 | A * | 5/1978 | Suzuki et al. | 363/17 |
| 4,172,964 | A * | 10/1979 | Reinebach | 178/46 |
| 4,318,066 | A * | 3/1982 | Degeneff et al. | 336/70 |
| 4,660,014 | A | 4/1987 | Wenaas et al. | 336/84 C |
| 4,977,301 | A * | 12/1990 | Maehara et al. | 219/715 |
| 6,420,952 | B1 | 7/2002 | Redilla | 336/84 M |
| 6,727,793 | B2 * | 4/2004 | Piechnick | 336/198 |
| 6,833,603 | B1 * | 12/2004 | Park et al. | 257/528 |
| 6,933,805 | B1 | 8/2005 | Norte et al. | 333/185 |

(Continued)

FOREIGN PATENT DOCUMENTS

WO WO 2009/034179 A2 * 3/2009

OTHER PUBLICATIONS

Authorized Officer: Mani Ramachandran, Written Opinion of the International Searching Authority, PCT/AU2010/000092, 6 pages, Jan. 29, 2010.

Authorized Officer: Mani Ramachandran, International Preliminary Report on Patentability, PCT/AU2010/000092, 14 pages, Jan. 29, 2010.

(Continued)

*Primary Examiner* — Alexander Talpalatski
*Assistant Examiner* — Mangtin Lian
(74) *Attorney, Agent, or Firm* — Sunstein Kann Murphy & Timbers LLP

(57) ABSTRACT

High frequency, high power density coaxial, planar and three-phase transformers for converters and inverters are disclosed. One of the coaxial transformers comprises at least one primary winding and at least one secondary winding associated with at least one magnetic core, at least one coaxial Faraday shield between and substantially coaxial with the at least one primary winding and the at least one secondary winding and a substantially planar Faraday shield at one or more ends of the at least one magnetic core.

21 Claims, 13 Drawing Sheets

(56) References Cited

U.S. PATENT DOCUMENTS

| | | | | |
|---|---|---|---|---|
| 2004/0032313 | A1* | 2/2004 | Ferencz et al. | 336/200 |
| 2004/0245969 | A1 | 12/2004 | McClean | 323/247 |
| 2005/0253678 | A1* | 11/2005 | Nishino et al. | 336/229 |
| 2008/0061915 | A1* | 3/2008 | Godbey | 336/96 |
| 2010/0090789 | A1* | 4/2010 | Schluter et al. | 336/192 |
| 2011/0018676 | A1* | 1/2011 | Young et al. | 336/84 C |

OTHER PUBLICATIONS

Authorized Officer: Mani Ramachandran, Notification of Transmittal of International Preliminary Report on Patentability, PCT/AU2010/000092, 1 page, Jan. 29, 2010.

L. Tihanyi, "7.4 Shielded Transformers", "*Noise Suppression*," from "Electromagnetic Compatibility in Power Electronics," pp. 143-146, IEEE [1995].

* cited by examiner

HIGH FREQUENCY TRANSFORMERS

FIELD OF THE INVENTION

The present invention relates to high frequency transformers. In particular, but not exclusively, embodiments of the present invention relate to high frequency, high power density transformers for DC/DC converters and DC/AC inverters for applications including, but not limited to, renewable energy power conversion systems, switching mode power supplies (SMPS) for communication systems and universal or uninterrupted power supplies (UPS).

BACKGROUND TO THE INVENTION

The requirement for developing high power density, high efficiency and low profile DC/DC converters and DC/AC inverters has exposed a number of limitations in the use of conventional wound-wire magnetic structures. A number of high frequency (HF) power transformers have been developed, such as conventional E core or pot core HF power transformers (first generation), planar core power transformers (second generation) and coaxial core power transformers (third generation).

The planar core and coaxial magnetic core structures exhibit many advantages such as their suitability for high frequency operation, high power density and small physical size. A smaller physical size is achievable with coaxial magnetic core structures because no heat sink is required by the coaxial magnetic core, which makes the actual converter size much smaller than the planar core.

The planar core and coaxial magnetic core structures also exhibit high efficiency, lower losses due to eddy currents and improved thermal control, the latter because the cooling surfaces on both the inner coil surface and the outer core surface are larger. The planar core and coaxial magnetic core structures further exhibit a low electromagnetic interference (EMI) problem, low leakage inductance and low coupling capacitance between the windings. Thus, planar core and coaxial magnetic core structures are chosen for HF power transformers in energy conversion systems.

However, in high frequency (HF) applications up to 1 MHz, the inter-winding capacitance couples HF noise from the primary winding to the secondary winding and causes serious common mode HF noise problems, as described by L. Tihanyi, Electromagnetic Compatibility in Power Electronics, Piscataway, N.Y., IEEE, 1995, pp. 143-146. The effect of such parasitic capacitances can not be neglected if the operating frequencies are above 100 kHz.

One attempted solution to this problem is the insertion of Faraday shields between the primary and secondary windings to suppress the HF noise coupled to the secondary winding. However, eddy currents are generated in the Faraday shields, which produce a heating effect, lead to demagnetization and reduce performance. Reference may be had to U.S. Pat. No. 6,420,952 B1 assigned to Core Technology Inc. and entitled Faraday Shield and Method as an example of a planar transformer including a Faraday shield between the primary and secondary windings. The Faraday shields in this patent comprise a plurality of low conductivity areas in the form of holes to restrict or inhibit the flow of eddy currents in the Faraday shields. However, it has been found that these Faraday shields still produce a heating effect leading to demagnetization, which prevents optimum performance being achieved.

Another problem with many prior art planar transformers is that they comprise many external connections between the multiple layers, which can be prone to damage.

Hence, there is a need to further reduce as much as possible the electromagnetic compatibility (EMC) and EMI problems of the prior art without increasing the eddy currents and/or address or at least ameliorate one or more of the other problems of the prior art.

In this specification, the terms "comprises", "comprising", "includes", "including" or similar terms are intended to mean a non-exclusive inclusion, such that a method, system or apparatus that comprises a list of elements does not include those elements solely, but may well include other elements not listed.

OBJECT OF THE INVENTION

It is a preferred object of the present invention to provide a high frequency transformer that reduces the EMC and EMI problems of the prior art without increasing the eddy currents.

It is a preferred object of the present invention to maximise the uniformity of the current and magnetic flux distributions in HF transformers.

It is a preferred object of the present invention to address or at least ameliorate one or more of the problems of the prior art and/or provide one or more useful commercial alternatives to the prior art.

SUMMARY OF THE INVENTION

Embodiments of the present invention relate to fully shielded, high frequency and high power density transformers particularly suitable for, but not limited to, DC/DC converters and/or DC/AC inverters.

In one form, although it need not be the only or indeed the broadest form, the invention resides in a high frequency, high power density coaxial transformer comprising:

at least one magnetic core;

at least one primary winding within the magnetic core;

at least one secondary winding within the magnetic core;

at least one coaxial Faraday shield between and substantially coaxial with the at least one primary winding and the at least one secondary winding; and a substantially planar Faraday shield at one or more ends of the at least one magnetic core.

Preferably, one of the substantially planar Faraday shields is provided at both ends of the at least one magnetic core.

Preferably, the substantially planar Faraday shield comprises a plurality of spaced apart raised portions separated by air gaps.

Suitably, the substantially planar Faraday shield comprises a comb-shaped configuration of raised portions or a fractal pattern of raised portions.

Preferably, the magnetic core is in the form of a hollow cylinder or toroid.

Preferably, the at least one primary winding is provided inside the at least one secondary winding.

Preferably, each substantially planar Faraday shield forms part of one end terminal of the coaxial transformer.

Suitably, each end terminal comprises a multi-layered printed circuit board (PCB).

Suitably, the coaxial transformer comprises four or eight magnetic cores comprising two or four adjacent pairs of stacked magnetic cores respectively. However, other numbers of magnetic cores may be used depending on the power rating.

In another form, although it need not be the broadest form, the invention resides in a high frequency, high power density planar transformer comprising:

at least one magnetic core;

at least one first substantially planar structure comprising at least one primary winding, the at least one primary winding associated with the magnetic core;

at least one second substantially planar structure comprising at least one secondary winding, the at least one secondary winding associated with the magnetic core; and at least one substantially planar Faraday shield between the at least one primary winding and the at least one secondary winding, wherein the at least one substantially planar Faraday shield comprises a plurality of spaced apart raised portions separated by air gaps.

Suitably, planar transformer comprises at least one substantially planar insulator between the at least one primary winding and the at least one planar Faraday shield and between the at least one secondary winding and the at least one planar Faraday shield.

Suitably, the magnetic core is in the form of a planar double E-shaped core or a planar E-I core.

Preferably, the at least one planar Faraday shield comprises a comb-shaped configuration of raised portions or a fractal pattern of raised portions.

Suitably, each first substantially planar structure is an insulation plate.

Suitably, each second substantially planar structure is a single-sided or double-sided printed circuit board (PCB).

Suitably, the planar transformer comprises a plurality of alternately positioned first substantially planar structures comprising at least one primary winding and second substantially planar structures comprising at least one secondary winding.

Preferably, the primary and secondary windings have identical shapes.

In a further form, although it need not be the broadest form, the invention resides in a high frequency, high power density, three-phase coaxial transformer comprising:

at least three magnetic cores;

at least two primary windings associated with each magnetic core;

at least two secondary windings associated with each magnetic core;

at least one coaxial Faraday shield between and substantially coaxial with the primary windings and the secondary windings for each magnetic core; and a substantially planar Faraday shield at one or more end of the magnetic cores.

Preferably, each substantially planar Faraday shield forms part of an end terminal of the three-phase coaxial transformer.

Preferably, each end terminal comprises one or more substantially planar insulators.

Suitably, at least one coaxial Faraday shield between the at least one primary winding and the at least one secondary winding is integrally formed with the substantially planar Faraday shield.

Suitably, the substantially planar Faraday shield comprises a plurality of spaced apart raised portions separated by air gaps.

Suitably, the substantially planar Faraday shield comprises a comb-shaped configuration of raised portions or a fractal pattern of raised portions.

In a yet further form, although it need not be the broadest form, the invention resides in a Faraday shield comprising a plurality of spaced apart raised portions separated by air gaps.

Suitably, the Faraday shield comprises a comb-shaped configuration of raised portions or a fractal pattern of raised portions.

Further features and forms of the present invention will become apparent from the following detailed description.

BRIEF DESCRIPTION OF THE DRAWINGS

By way of example only, preferred embodiments of the invention will be described more fully hereinafter with reference to the accompanying drawings in which like features have like reference numerals, wherein.

Skilled addressees will appreciate that elements in the figures are illustrated for simplicity and clarity and have not necessarily been drawn to scale. For example, the relative dimensions of some of the elements in the figures may be distorted to help improve understanding of embodiments of the present invention.

DETAILED DESCRIPTION OF THE INVENTION

A high frequency, high power density coaxial transformer and parts thereof according to embodiments of the present invention are shown in FIGS. 1-5. The coaxial transformer 10 comprises at least one magnetic core 12 formed from any suitable conventional magnetic material, such as ferrite ceramics, which are particularly good for high frequency applications. Other possible materials include soft iron, carbonyl iron, silicon alloyed iron and powdered iron and the magnetic core 12 can be laminated to further reduce eddy currents.

Figure 1:
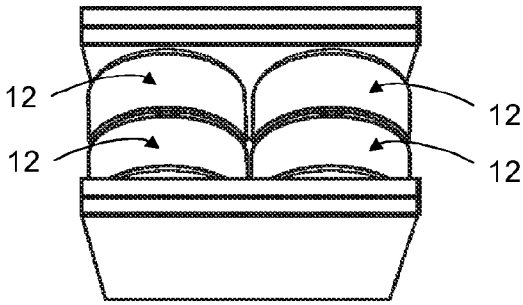
FIG. 1 is an image of a fully shielded, high frequency coaxial transformer comprising four magnetic ring cores according to embodiments of the present invention.
Figure 2:
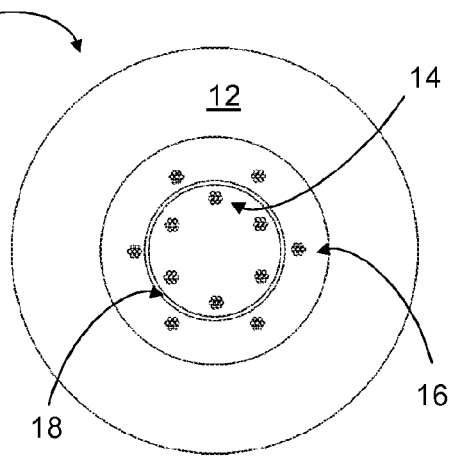
FIG. 2 is a schematic cross section of one of the magnetic ring cores shown in FIG. 1.

In the embodiments shown in FIGS. 1-5, the coaxial transformer 10 comprises four stacked magnetic cores comprising two adjacent lower magnetic cores 12A, 12B and two adjacent upper magnetic cores 12C, 12D. As shown in FIG. 2, according to some embodiments, the magnetic cores 10 are in the form of hollow cylinders or toroids, which help achieve a highly efficient, low radiation transformer with minimal electromagnetic interference (EMI).

With reference to FIG. 2, the coaxial transformer 10 comprises at least one primary winding 14 within the magnetic core 12 and at least one secondary winding 16 within the magnetic core 12. In the embodiment shown, the primary winding 14 is the inner winding and is provided inside the secondary winding 16. The coaxial transformer 10 comprises a conductor in the form of at least one thin Faraday shield 18 between the primary winding 14 and the secondary winding 16. In preferred embodiments, the Faraday shield 18 is cylindrical in shape and substantially coaxial with the primary winding 14 and the secondary winding 16. According to preferred embodiments and as shown in FIGS. 1, 2 and 4, the primary and secondary windings 14, 16 are provided entirely within the magnetic core 12.

Figure 3:
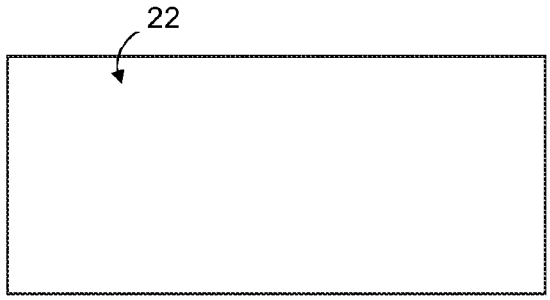
FIG. 3 is a plan view of the transformer shown in FIG. 1.
Figure 4:
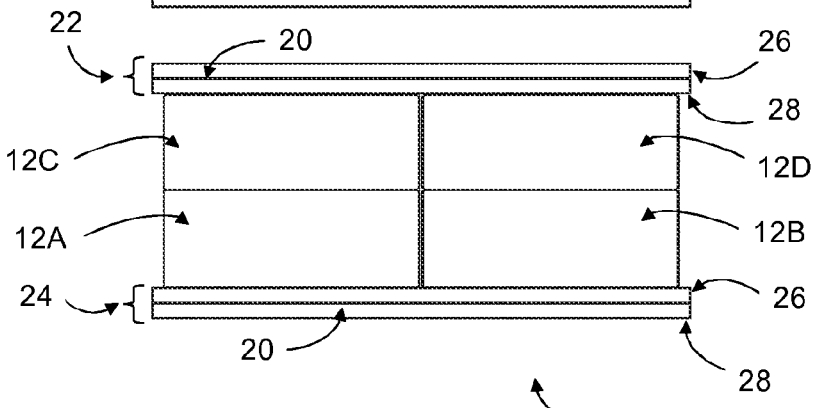
FIG. 4 is a side view of the transformer shown in FIG. 1.

With reference to FIGS. 3 and 4, the coaxial transformer 10 comprises a substantially planar conductor at each end of the magnetic core 12 in the form of at least one substantially planar Faraday shield 20. The substantially planar Faraday shields 20 form part of the end terminals 22, 24 at the top and bottom of the magnetic core 12. The combination of the Faraday shield 18 between the primary winding 14 and the secondary winding 16 and the substantially planar Faraday shields 20 at the ends of the magnetic cores provides a fully shielded high frequency coaxial transformer (HFCT) 10.

In the embodiment shown in FIGS. 1, 3 and 4, the end terminals 22, 24 comprise multiple layers with the substantially planar Faraday shield 20 comprising one of the layers. In the embodiment shown in FIG. 4, the substantially planar Faraday shield 20 of each end terminal 22, 24 is positioned in between a pair of printed circuit boards (PCBs) 26, 28. However, in alternative embodiments the substantially planar Faraday shield 20 can be formed on or embedded in one of the PCBs.

Figure 5:
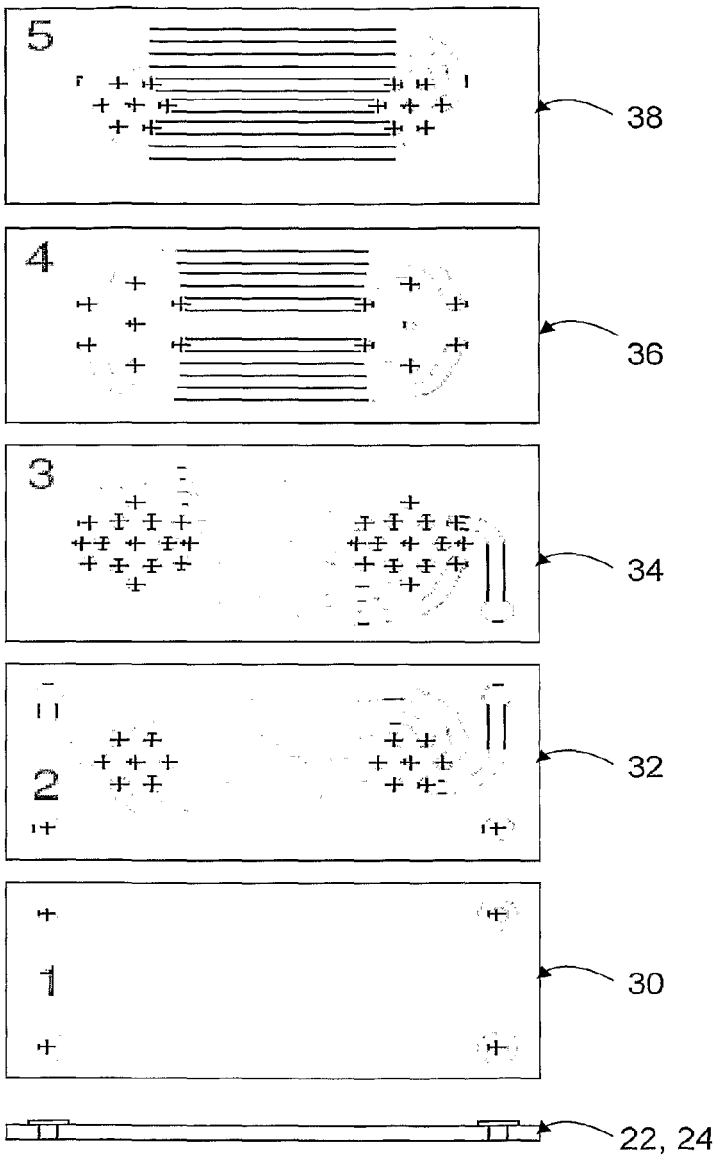
FIG. 5 is a side view of an end terminal and a series of plan views showing the connections between layers comprising the end terminals of the transformer shown in FIG. 1.

With reference to FIG. 5, according to some embodiments, the end terminals 22, 24 can comprise a multi-layered printed circuit board and FIG. 5 shows an example of the winding connections between five different layers 30, 32, 34, 36, 38 comprising each end terminal.

Figure 6:
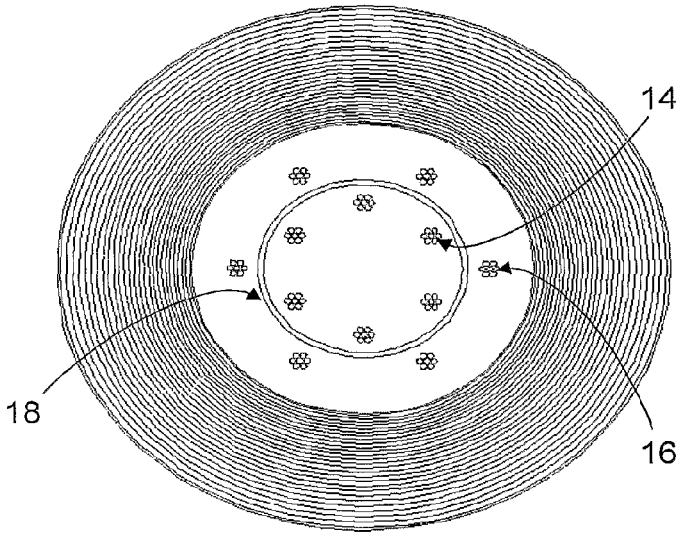
FIG. 6 is a diagram showing a simulation of the flux distribution of the transformer shown in FIG. 1 under open circuit conditions when the inner winding is used as the primary winding.
Figure 7:
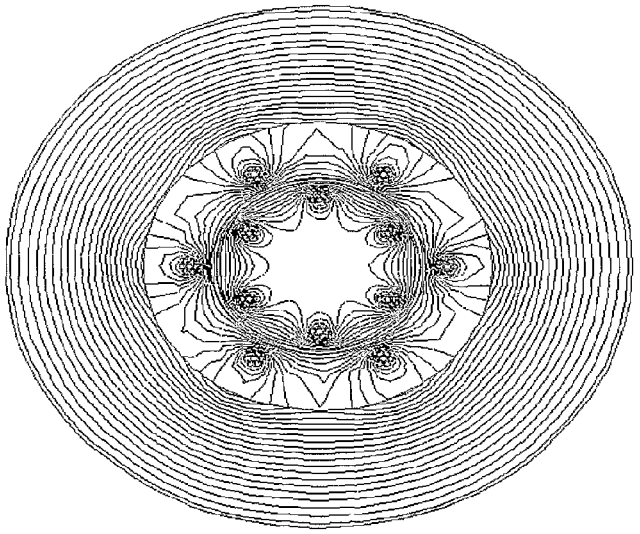
FIG. 7 is a diagram showing a simulation of the flux distribution of the transformer shown in FIG. 1 under short circuit conditions when the inner winding is used as the primary winding.
Figure 8:
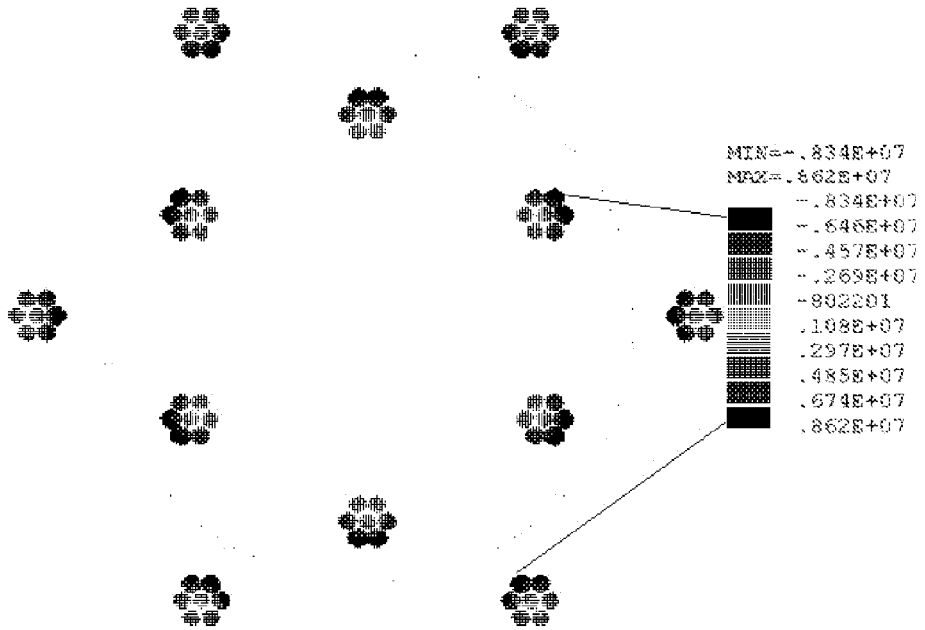
FIG. 8 is a diagram showing a simulation of the current distribution of the transformer shown in FIG. 1 under short circuit conditions.
Figure 9:
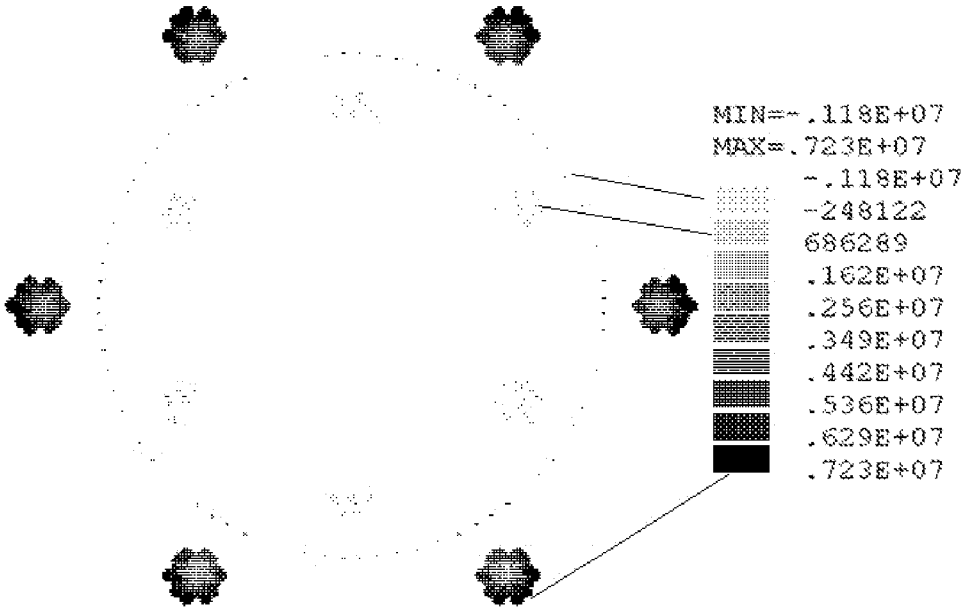
FIG. 9 is a diagram showing a simulation of the current distribution of the transformer shown in FIG. 1 under open circuit conditions.

FIG. 6 is a diagram showing a simulation of the flux distribution of the high frequency, high power density coaxial transformer 10 under open circuit conditions when the inner winding is used as the primary winding 10. FIG. 7 is a diagram showing a simulation of the flux distribution of the high frequency, high power density coaxial transformer 10 under short circuit conditions when the inner winding is used as the primary winding 14. These diagrams illustrate that the thin coaxial Faraday shield 18 between the primary winding 14 and the secondary winding 16 and the planar Faraday shield 20 of each end terminal 22, 24 provide a fully-shielded, high frequency, high power density coaxial transformer 10 and the thin coaxial Faraday shield 18 acts as a magnetic flux balancing device. Consequently, losses due to eddy currents caused by the proximity effect are reduced and uniform current and magnetic flux distributions are achieved, as shown in FIGS. 8 and 9. FIG. 8 is a diagram showing a simulation of the current distribution of the transformer 10 under short circuit conditions and FIG. 9 is a diagram showing a simulation of the current distribution of the transformer 10 under open circuit conditions.

Figure 13:
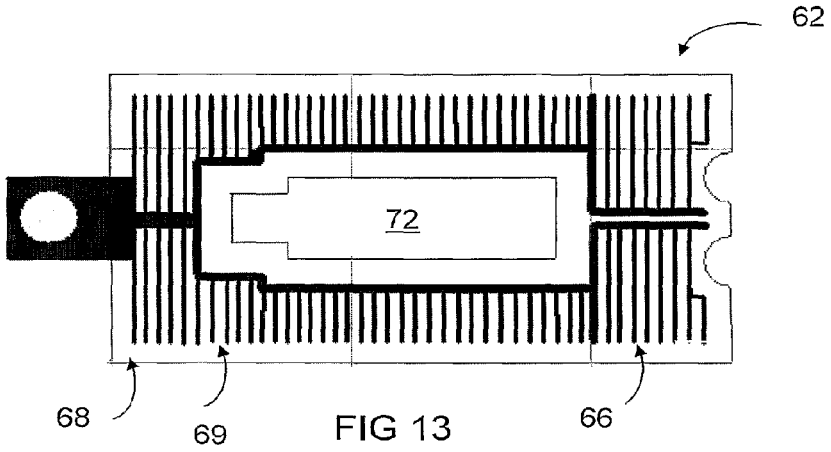
FIG. 13 is a plan view of a comb-shaped Faraday shield for a fully shielded high frequency planar core transformer.
Figure 14:
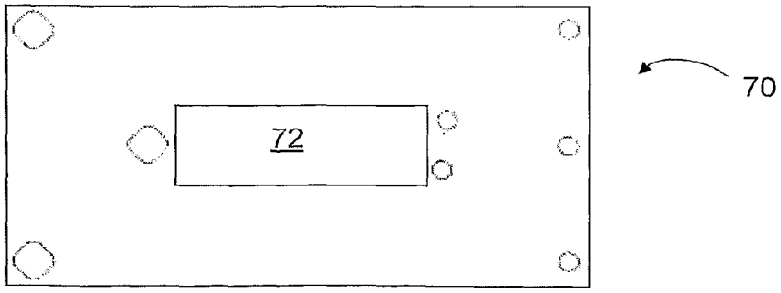
FIG. 14 is a plan view of an insulator for a fully shielded high frequency planar core transformer.
Figure 15:
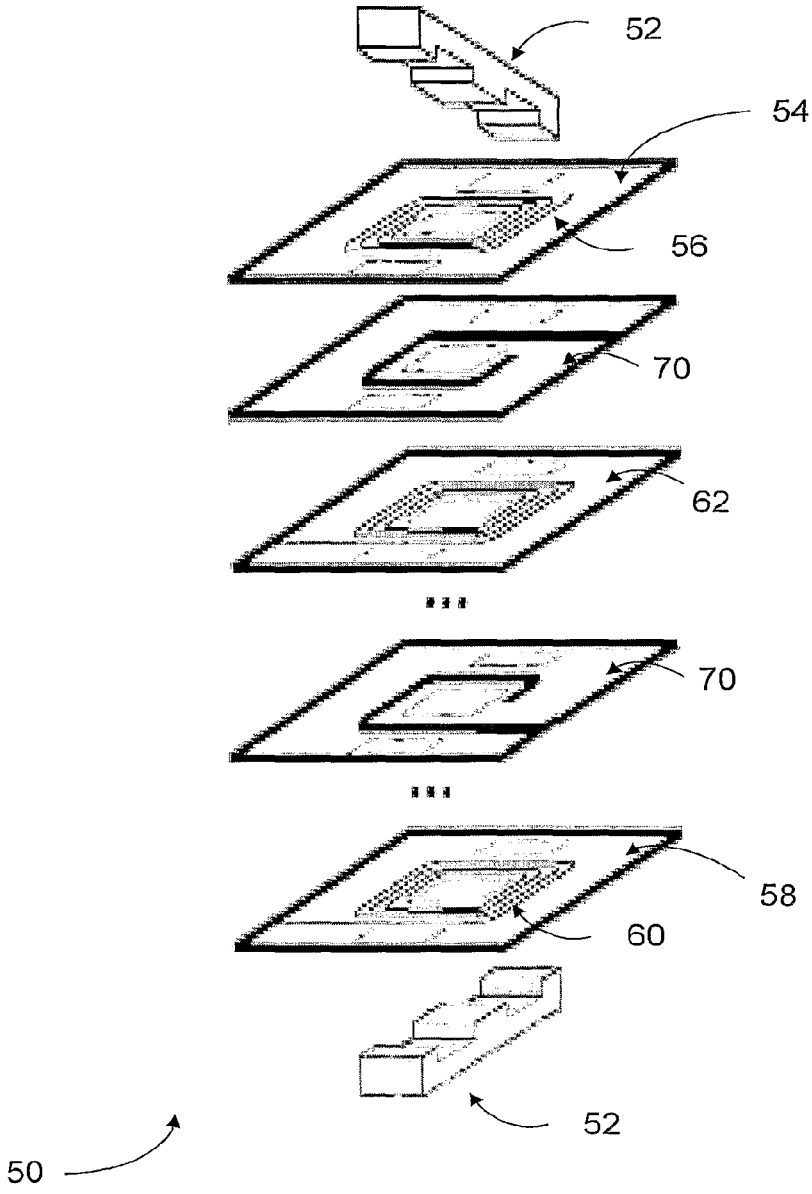
FIG. 15 is an exploded view showing the construction of a multi-layer, planar double E-core transformer.

A high frequency, high power density planar transformer and parts thereof according to other embodiments of the present invention are shown in FIGS. 10-15. With reference to FIG. 15 initially, the planar transformer 50 comprises at least one magnetic core 52, which is formed from any suitable conventional magnetic material, examples of which have been previously stated herein. Optionally, the at least one magnetic core 52 can be laminated to reduce eddy currents. In the embodiment shown in FIG. 15, two magnetic cores 52 in the form of planar double E-shaped cores are provided. However, it will be appreciated that other shapes can be employed for the magnetic core(s) 52, such as E-I shaped cores, C-shaped or U-shaped cores.

Figure 12:
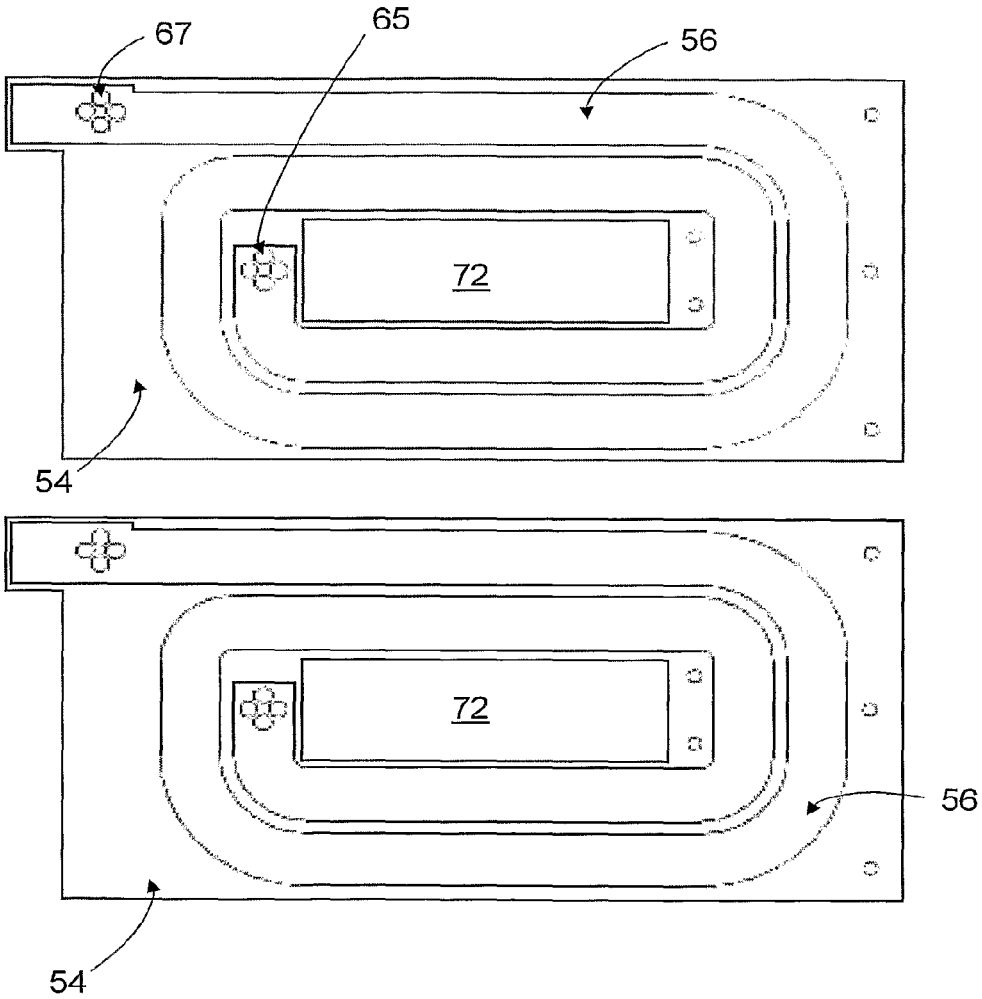
FIG. 12 is a plan view of insulation plates comprising primary windings for a fully shielded high frequency planar core transformer.

With reference to FIG. 12, the planar transformer 50 comprises at least one first substantially planar structure 54 comprising at least one primary winding 56, which will be associated with the magnetic core 52 in the assembled planar transformer 50. According to preferred embodiments, the first substantially planar structure 54 is in the form of an insulation plate made from any suitable plastics material. One or more primary windings 56 are formed on or embedded in the first substantially planar structure 54 by any suitable method known in the art.

Figure 10:
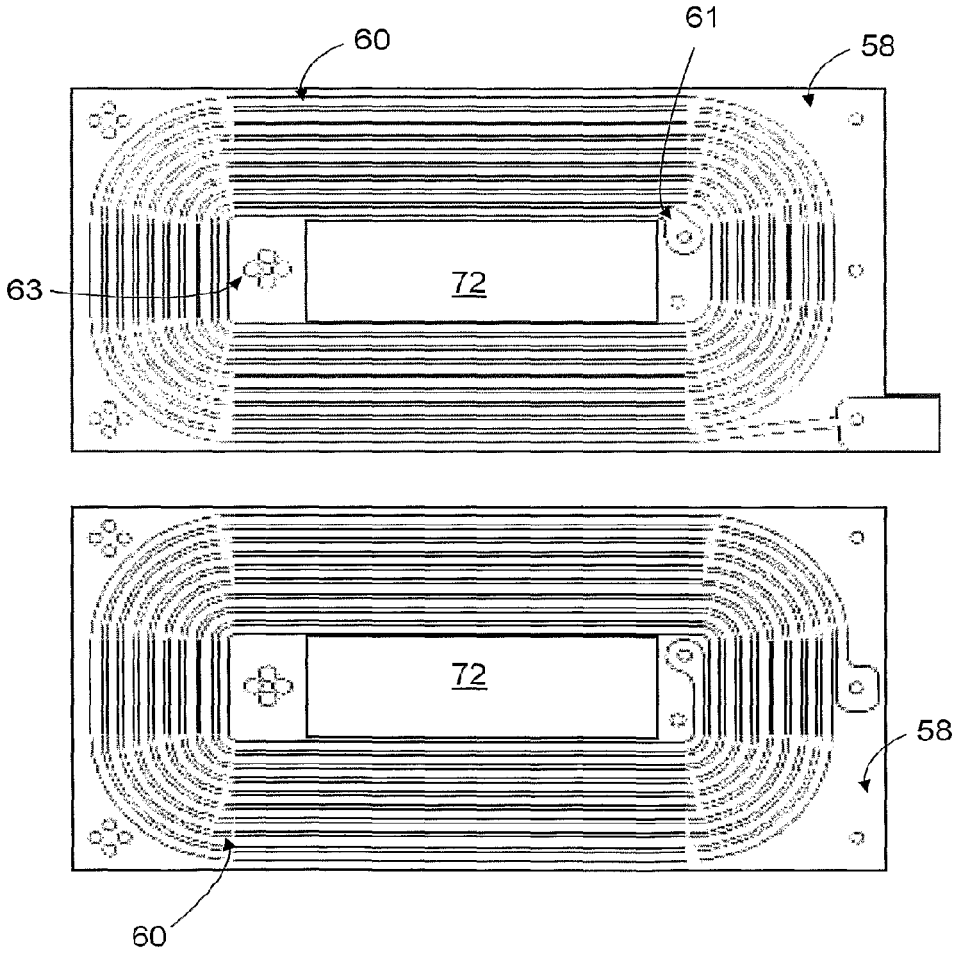
FIG. 10 is a plan view of single-sided printed circuit boards (PCBs) comprising secondary windings for a fully shielded high frequency planar core transformer according to other embodiments of the present invention.
Figure 11:
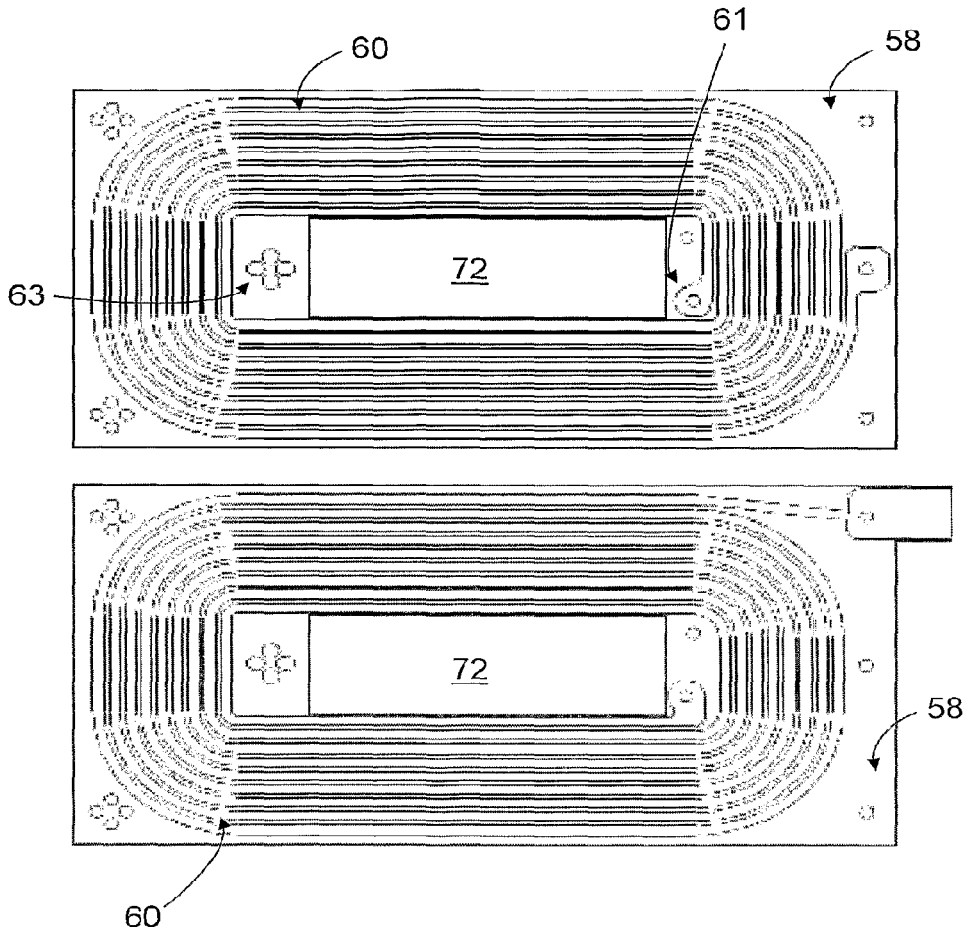
FIG. 11 is a plan view of double-sided PCBs comprising secondary windings for a fully shielded high frequency planar core transformer.

With reference to FIGS. 10 and 11, the planar transformer 50 also comprises at least one second substantially planar structure 58 comprising at least one secondary winding 60, which will be associated with the magnetic core 52 in the assembled planar transformer 50. According to some embodiments, the second substantially planar structure 58 is in the form of a single-sided printed circuit board (PCB) in which at least one secondary winding 60 is formed on or embedded in a single side of the PCB, as shown in FIG. 10. Alternatively, the second substantially planar structure 58 is in the form of a double-sided PCB in which at least one secondary winding 60 is formed on or embedded in both sides of the PCB, as shown in FIG. 11. The double-sided PCB comprising at least one secondary winding 60 on each side reduces the number of connections required between different layers thus simplifying construction of the planar transformer.

It will be noted that the substantially planar structures 54, 58 comprising the primary and secondary windings 56, 60 comprise connections, such as connections 61, 63, 65, 67, with the perimeters of the planar structures 54, 58 to provide internal connections rather than external connections between the layers of the planar transformer. The internal connections are protected by the structure of the planar transformer thus reducing the likelihood of damage to the connections.

Figure 13A:
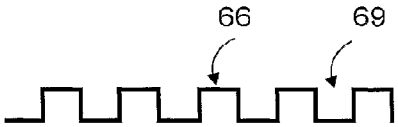
FIGS. 13A and 13B are sectional views showing examples of structures of Faraday shields.
Figure 13B:
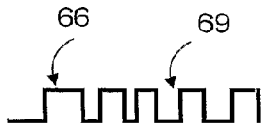

Referring to FIG. 13, the planar transformer 50 comprises at least one substantially planar Faraday shield 62 between the at least one primary winding 56 and the at least one secondary winding 60. According to preferred embodiments and with additional reference to FIGS. 13A and 13B, the substantially planar Faraday shield 62 comprises a plurality of spaced apart raised portions or ridges 66 protruding from the surface 68 of the Faraday shield 62. The spaced apart raised portions 66 are separated by air gaps 69. The raised portions 66 can be of substantially equal thickness and regularly spaced between substantially equally sized air gaps 69, as shown in FIG. 13A. For example, the planar Faraday shield can comprise a comb-shaped configuration 64 formed on a single side of a PCB, as shown in FIG. 13. In alternative embodiments, the comb-shaped configuration 64 can be formed on both sides of a PCB or formed as a separate element and not as part of one of the PCBs. Alternatively, the raised portions 66 can be of various thicknesses and irregularly spaced between unequally sized air gaps 69, similar to a barcode configuration, as shown in FIG. 13A. As another alternative, raised portions 66 of various thicknesses can be regularly spaced between equally sized air gaps 69. The barcode configuration could also be used to identify the product. In another alternative, the substantially planar Faraday shield 62 can comprise a fractal pattern of raised portions 66 separated by air gaps 69.

According to preferred embodiments, the width of the raised portions 66 is approximately twice the skin depth. The skin depth is the depth within the conductors at which eddy currents exist, as illustrated, for example, by the surface hot spots in the simulation shown in FIGS. 8 and 9.

The aforementioned structures for the substantially planar Faraday shield 62 comprising a plurality of spaced apart raised portions separated by air gaps can also be used for the substantially planar Faraday shield 20 in the previous embodiments of the coaxial transformer 10.

Referring to FIG. 14, embodiments of the planar transformer 50 further comprise at least one substantially planar insulator 70 made from any suitable plastics material. In the assembled planar transformer 50, the substantially planar insulator 70 is positioned between the at least one primary winding 56 and the at least one substantially planar Faraday shield 62 and/or between the at least one secondary winding 60 and the at least one substantially planar Faraday shield 62. Multiple, separate substantially planar insulators 70 can be employed or a single insulating element comprising multiple insulating planes As shown in FIGS. 10-14, first and second substantially planar structures 54, 58, substantially planar Faraday shield 62 and substantially planar insulator 70 each comprise an aperture 72 through which part of the magnetic core 52 protrudes in the assembled planar transformer 50.

As shown in the exploded view of FIG. 15, the assembled planar transformer 50 comprises a plurality of alternately positioned first substantially planar structures 54 comprising at least one primary winding 56 and second substantially planar structures 58 comprising at least one secondary winding 60. At least one substantially planar Faraday shield 62 is positioned between each primary winding 56 and secondary winding 60. Substantially planar insulators 70 are positioned between each primary winding 56 and a respective substantially planar Faraday shield 62 and between each secondary winding 60 and the respective substantially planar Faraday shield 62. Hence, according to some embodiments, a set of layers can comprise the following in order: primary winding 56; planar insulator 70; planar Faraday shield 62; planar insulator 70; secondary winding 60, as shown in FIG. 15. The planar transformer 50 comprises one or more sets of primary and secondary windings 56, 60, substantially planar Faraday shields 62 and substantially planar insulators 70 and the number of sets depends on the particular application for the planar transformer 50.

The low power loss planar Faraday shields 62 having the comb-shaped configuration 64 minimize the induced eddy currents and the impact on the magnetizing impedance. Also, the winding shapes of the primary windings 56 and the secondary windings 60 are identical, thus simplifying the structures and reducing manufacturing costs. The size, shape and width of the windings will depend on the magnetic structure, voltage, current and power rating.

A high frequency, high power density three-phase coaxial transformer and parts thereof according to other embodiments of the present invention are shown in FIGS. 16-19. The three-phase coaxial transformer 80 converts power supplied in three different phases and comprises fully shielded windings as with the previous embodiments. The three-phase coaxial transformer 80 comprises at least three magnetic cores 82 formed from any suitable conventional magnetic material, examples of which have been previously stated herein. Optionally, the magnetic cores 82 can be laminated to reduce eddy currents.

Figure 16:
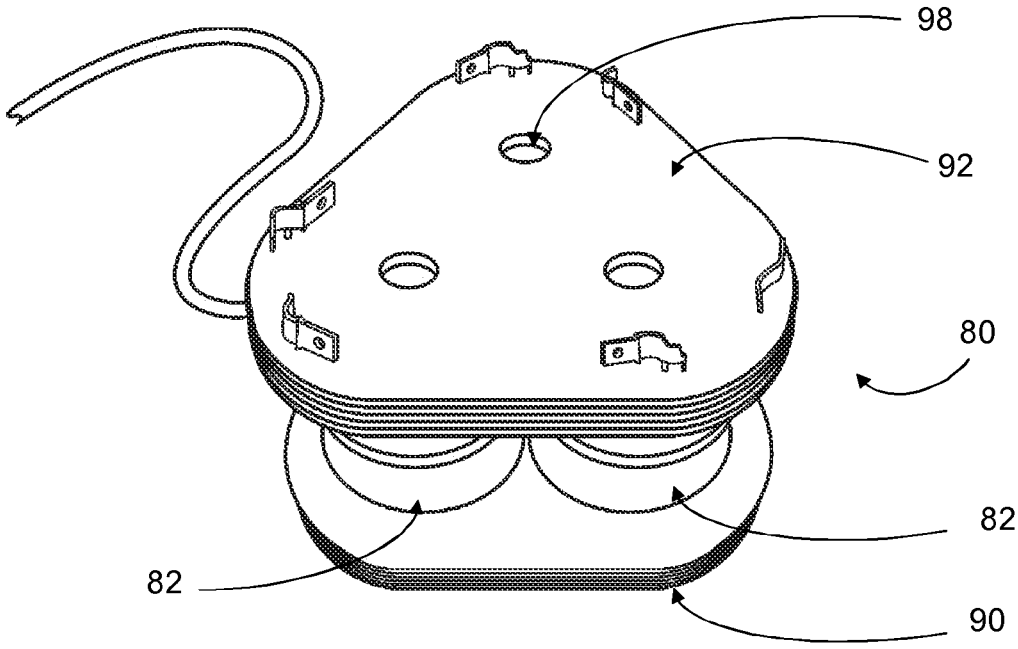
FIG. 16 is an image of a fully shielded high frequency three-phase coaxial transformer comprising six magnetic ring cores according to further embodiments of the present invention.
Figure 17:
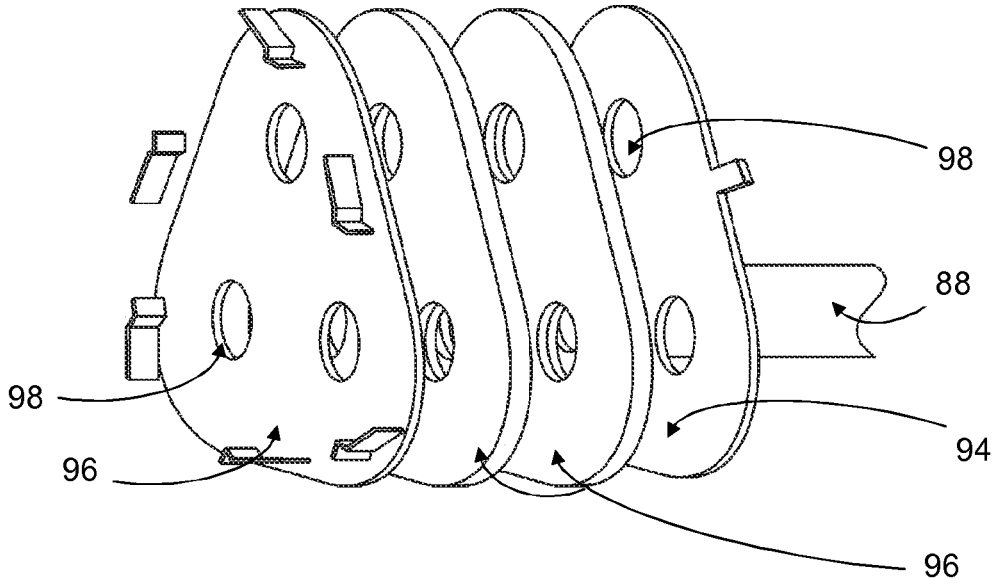
FIGS. 17 and 18 are perspective views showing coaxial Faraday shielding and planar Faraday shielding of the end terminals of the three-phase coaxial transformer shown in FIG. 16.
Figure 18:
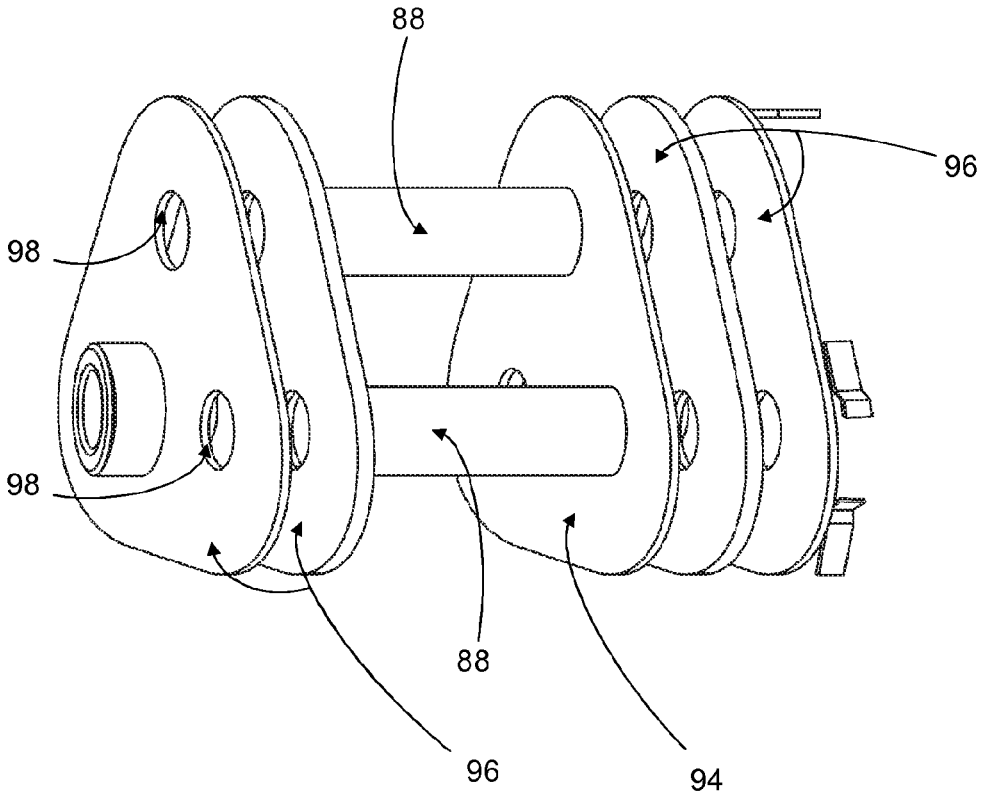
Figure 19:
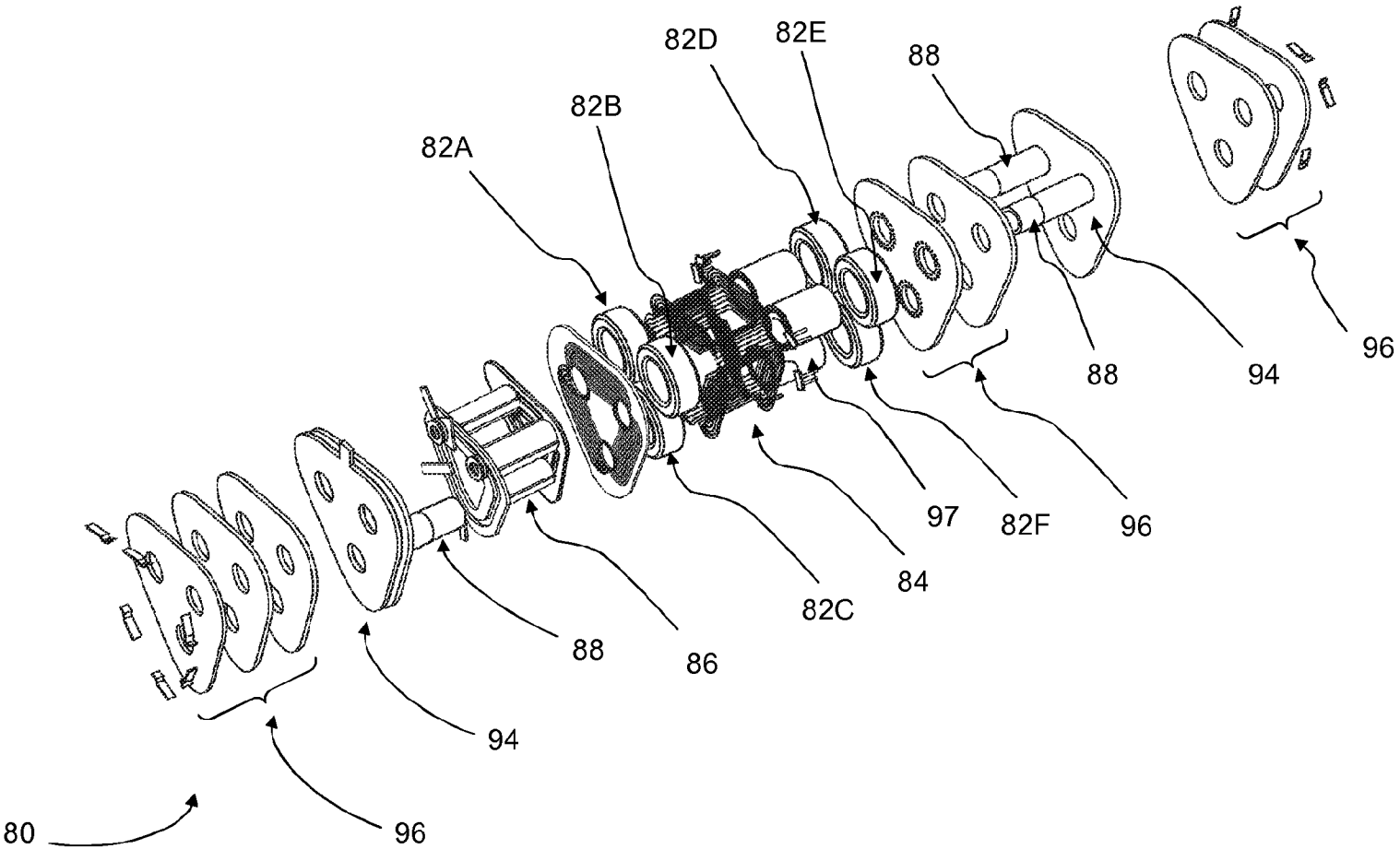
FIG. 19 is an exploded perspective view of the three-phase coaxial transformer shown in FIG. 16.

In the embodiments shown in FIGS. 16-19, the three-phase coaxial transformer 80 comprises six magnetic cores 82 comprising three adjacent lower magnetic cores 82A, 82B, 82C and three adjacent upper magnetic cores 82D, 82E, 82F. As shown in FIGS. 16 and 19, according to some embodiments, the magnetic cores 10 are in the form of hollow cylinders or toroids, which help achieve a highly efficient, low radiation and minimal EMI three-phase transformer.

Each magnetic core 82, or each pair of magnetic cores, comprises at least three primary windings 84 associated with each magnetic core 82, or magnetic core pair, and at least three secondary windings 86 associated with each magnetic core 82, or magnetic core pair. The primary windings 84 can be the inner winding and in such an embodiment is provided inside the secondary windings 86.

The three-phase coaxial transformer 80 comprises a conductor in the form of at least one thin coaxial Faraday shield 88 between the primary windings 84 and the secondary windings 86 for each magnetic core 82, or magnetic core pair. In preferred embodiments, each coaxial Faraday shield 88 is cylindrical in shape and substantially coaxial with the primary windings 84 and secondary windings 86.

The three-phase coaxial transformer 80 comprises end terminals 90, 92 at each end of the magnetic cores 82 and in the embodiments shown in FIGS. 16-19, the end terminals 90, 92 comprise multiple layers. One of the layers of the end terminals 90, 92 is in the form of a substantially planar Faraday shield 94, which can form part of a PCB or be formed separately.

The aforementioned structures for the substantially planar Faraday shield 62 comprising a plurality of spaced apart raised portions separated by air gaps can also be used for the substantially planar Faraday shield 94 for embodiments of the three-phase coaxial transformer 80.

Other layers of the end terminals 90, 92 are in the form of one or more substantially planar insulators 96. In the embodiments shown in FIGS. 16-19, the end terminals 90, 92 comprise five separate substantially planar insulators 96, but other numbers of substantially planar insulators 96 could be used. The three-phase coaxial transformer 80 also comprises supporting insulation in the form of insulating cylinders 97. Substantially planar insulators 96 and insulating cylinders 97 can be made of any suitable rigid insulating material, such as fiberglass, which provides support to the three-phase coaxial transformer 80.

To simplify production and reduce production costs, the substantially planar Faraday shields 94 and the substantially planar insulators 96 have the same shape and have a substantially triangular shape to efficiently accommodate the at least three magnetic cores 82. In preferred embodiments, one of the thin cylindrical Faraday shields 88 is integrally formed with one of the substantially planar Faraday shields 94. With particular reference to FIGS. 17 and 18, one of the substantially planar Faraday shields 94 for one of the end terminals comprises two thin Faraday shields 88 integrally formed therewith and the substantially planar Faraday shield 94 of the other end terminal comprises one thin cylindrical Faraday shield 88 integrally formed therewith.

The substantially planar Faraday shields 94 and the substantially planar insulators 96 comprise a plurality of apertures 98 therethrough to allow for the nesting of the planar insulators 96 with the thin cylindrical Faraday shields 88 and the planar Faraday shields 94 to form a compact three-phase coaxial transformer 80.

The Faraday shields described herein are preferably made of copper, but can be made of other conductive materials or a combination of conductive materials, examples of which include, but are not limited to, gold, silver, platinum, metallic alloys.

The combination of the coaxial Faraday shields 88 between the primary winding 84 and the secondary winding 86 and the substantially planar Faraday shields 94 of the end terminals provides a fully shielded high frequency, high density three-phase coaxial transformer 80. The thin coaxial Faraday shields 88 also act as magnetic flux balancing devices and consequently losses due to eddy currents caused by the proximity effect are reduced and uniform current and magnetic flux distributions are achieved.

Hence, the high frequency, high power density transformers according to embodiments of the present invention thus provide solutions to the aforementioned problems of the prior art by providing fully shielded transformers in which the eddy currents caused by the proximity effect are reduced and in which substantially uniform current and magnetic flux distributions are achieved. The transformers according to embodiments of the present invention also reduce EMC and EMI problems as a result of the full Faraday shielding of the primary and secondary windings. The Faraday shields comprising a plurality of spaced apart raised portions 66 separated by air gaps 69 provide improved shielding compared with at least some prior art Faraday shields and thus minimise the occurrence of eddy currents. Consequently, the Faraday shields reduce heating of the transformers thus minimising the demagnetization effect. The identical shape of the primary and secondary windings also simplify the manufacturing process of the planar transformer and reduce manufacturing costs. Furthermore, embodiments of the planar transformers 50 described herein comprise fewer external connections between the multiple layers, thus reducing the risk of damage to the planar transformers.

Throughout the specification the aim has been to describe embodiments of the invention without limiting the invention to any one embodiment or specific collection of features. Persons skilled in the relevant art may realize variations from the specific embodiments that will nonetheless fall within the scope of the invention.

The invention claimed is:

1. A high frequency, high power density coaxial transformer comprising:

at least one stacked pair of magnetic ring cores;

at least one primary winding within each magnetic ring core;

at least one secondary winding within each magnetic ring core, the primary winding being within the secondary winding;

at least one ring-shaped Faraday shield between the at least one primary winding and the at least one secondary winding and substantially coaxial with the magnetic ring core, the ring-shaped Faraday shield having a radius greater than a radius of the at least one primary winding and less than a radius of the at least one secondary winding and a radius of the magnetic ring core; and a substantially planar Faraday shield at one or more ends of the at least one stacked pair of magnetic ring cores.

2. The coaxial transformer of claim 1, wherein a substantially planar Faraday shield is provided at both ends of the at least one pair of magnetic cores.

3. The coaxial transformer of claim 1, wherein the substantially planar Faraday shield comprises a plurality of spaced apart raised portions separated by air gaps.

4. The coaxial transformer of claim 3, wherein the substantially planar Faraday shield comprises a comb-shaped configuration of raised portions.

5. The coaxial transformer of claim 1, wherein the at least one pair of magnetic cores is in the form selected from one of the following: a pair of hollow cylinders; a pair of toroids.

6. The coaxial transformer of claim 1, wherein each substantially planar Faraday shield forms part of one end terminal of the coaxial transformer.

7. The coaxial transformer of claim 6, wherein each end terminal comprises at least one multi-layered printed circuit board (PCB).

8. The coaxial transformer of claim 7, wherein the relationship between each Faraday shield and PCB is selected from one of the following: the Faraday shield is formed on one of the PCBs; the Faraday shield is embedded in one of the PCBs; the Faraday shield is positioned between one of the PCBs.

9. The coaxial transformer of claim 1, wherein the coaxial transformer comprises four or eight magnetic cores comprising two or four adjacent pairs of stacked magnetic cores respectively.

10. The coaxial transformer of claim 3, wherein a width of each of the plurality of spaced apart raised portions is approximately twice a depth at which eddy currents exist within the at least one substantially planar Faraday shield.

11. The coaxial transformer of claim 3 wherein the raised portions are of substantially equal thickness.

12. The Faraday shield of claim 10 wherein the raised portions are of unequal thickness.

13. The Faraday shield of claim 10 wherein the air gaps are of substantially equal width.

14. The Faraday shield of claim 10 wherein the air gaps are of unequal width.

15. The coaxial transformer of claim 8, wherein, where the Faraday shield is formed on one of the PCBs, the Faraday shield is formed on one or both sides of the PCB.

16. A high frequency, high power density, three-phase coaxial transformer comprising:

at least three magnetic ring cores;

at least three primary windings within each magnetic ring core;

at least three secondary windings within each magnetic ring core, the primary windings being within the secondary windings;

at least one coaxial Faraday shield between the primary windings and the secondary windings for each magnetic ring core and substantially coaxial with the magnetic ring core, the ring-shaped Faraday shield having a radius greater than a radius of the at least one primary winding and less than a radius of the at least one secondary winding and a radius of the magnetic ring core; and a substantially planar Faraday shield at one or more end of the magnetic ring cores.

17. The three-phase coaxial transformer of claim 16, wherein each substantially planar Faraday shield forms part of an end terminal of the three-phase coaxial transformer.

18. The three-phase coaxial transformer of claim 17, wherein each end terminal comprises one or more substantially planar insulators.

19. The three-phase coaxial transformer of claim 16, wherein at least one coaxial Faraday shield between the primary windings and the secondary windings is integrally formed with the substantially planar Faraday shield.

20. The three-phase coaxial transformer of claim 16, wherein the substantially planar Faraday shield comprises a plurality of spaced apart raised portions separated by air gaps.

21. The three-phase coaxial transformer of claim 20, wherein the substantially planar Faraday shield comprises a comb-shaped configuration of raised portions.

* * * * *

UNITED STATES PATENT AND TRADEMARK OFFICE

CERTIFICATE OF CORRECTION

PATENT NO. : 8,629,746 B2
APPLICATION NO. : 13/144297
DATED : January 14, 2014
INVENTOR(S) : Jun Wei Lu It is certified that error appears in the above-identified patent and that said Letters Patent is hereby corrected as shown below:

In the Claims:

In Column 10, Line 32
Replace "between each Faraday shield and PCB"
with --between each substantially planar Faraday shield and PCB--

In Column 10, Line 43
Replace "within the at least one substantially planar Faraday shield"
with --within the substantially planar Faraday shield--

In Column 10, Line 46
Replace "The Faraday shield of claim 10"
with --The coaxial transformer of claim 3--

In Column 10, Line 48
Replace "The Faraday shield of claim 10"
with --The coaxial transformer of claim 3--

In Column 10, Line 50
Replace "The Faraday shield of claim 10"
with --The coaxial transformer of claim 3--

Signed and Sealed this
First Day of July, 2014

Michelle K. Lee

Michelle K. Lee
*Deputy Director of the United States Patent and Trademark Office*